US005816401A

United States Patent [19]

Vasudeva et al.

[11] Patent Number: 5,816,401

[45] Date of Patent: Oct. 6, 1998

[54] HEX KEY HOLDER

[75] Inventors: Kailash C. Vasudeva, Waterloo; Maz A. Hasan, Kitchener, both of Canada

[73] Assignee: Maxtech, Inc., Mich.

[21] Appl. No.: 907,942

[22] Filed: Aug. 11, 1997

[51] Int. Cl.[6] ..... B65D 73/00

[52] U.S. Cl. ..... 206/377; 206/481; 206/806; 206/807; 211/70.6

[58] Field of Search ..... 206/1.5, 349, 372, 206/376–379, 467, 470, 481–483, 806, 807; 211/60.1, 70.6

[56] References Cited

U.S. PATENT DOCUMENTS

| | | | |
|---|---|---|---|
| 2,509,507 | 5/1950 | Kane | 206/377 |
| 2,590,307 | 3/1952 | Gibson | 206/377 |
| 4,378,068 | 3/1983 | Bell | 206/806 |
| 4,729,473 | 3/1988 | Kulzer et al. | 206/481 |
| 4,899,882 | 2/1990 | Benner | 206/806 |
| 5,044,591 | 9/1991 | Huang | 211/70.6 |
| 5,713,467 | 2/1998 | Kao | 206/377 |

*Primary Examiner*—Paul T. Sewell
*Assistant Examiner*—Luan K. Bui
*Attorney, Agent, or Firm*—R. Craig Armstrong

[57] ABSTRACT

In the invention, a hexagonal lid is pivotably connected to a generally flat body. A number of conventional hex keys of different sizes are secured within a plurality of plastic retaining members molded to the body such that both ends of the hex keys project out of the lid through notches in opposing sides of the lid to allow the consumer to touch the hex keys. The long ends of the hex keys project downwardly out of the lid generally parallel to the side edge of the body, and the short ends of the hex keys project out of the lid onto the top portion of the body parallel to the top edge of the body. Unauthorized removal of the hex keys at the point of sale is prevented by a block secured to the top portion of the body by a clip which penetrates a slit defined in the body. After purchasing the hex keys and the holder, the consumer can remove the block, insert hex keys into the block through preferably circular channels defined therein, and clip the block onto his/her belt or pocket to carry the hex keys to the job site or other destination.

7 Claims, 11 Drawing Sheets

HEX KEY HOLDER

BACKGROUND OF THE INVENTION

1. Field of the Invention

This invention relates to tool cases, and in particular, to a hex key holder used for the display of hex keys at the point of sale, and to subsequently store the tool set. It is desirable to display hex keys at the point of sale so that the consumer can touch and inspect the hex keys. Unfortunately, display cases which expose the tools are often prone to theft and/or tampering.

2. Summary of the Invention

It is an object of the invention to provide an improved hex key holder which allows the consumer to touch and inspect the hex keys, while at the same time being tamper-resistant and theft-resistant. In addition, the invention allows the user greater flexibility by providing additional useful features such as a mini hex key holder which can be detached from the main case and clipped to a belt to be carried to a job site.

In the invention, a preferably hexagonal lid is pivotably connected to a generally flat and preferably rectangular body. A number of conventional hex keys of different sizes are secured within a plurality of plastic retaining members molded to the body such that both ends of the hex keys project out of the lid through notches in opposing sides of the lid to allow the consumer to touch the hex keys. The long ends of the hex keys project out of the lid onto the lower portion of the body parallel to the length thereof and the short ends of the hex keys project out of the lid onto the upper portion of the body parallel to the width of the body. Unauthorized removal of the hex keys at the point of sale is prevented by a block secured to the top portion of the body by a clip which penetrates a slot defined in the body.

After purchasing the hex keys and the holder, the consumer can remove the block, insert hex keys into the block through preferably circular channels defined therein, and clip the block onto his/her belt to carry the hex keys to the job site or other destination.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
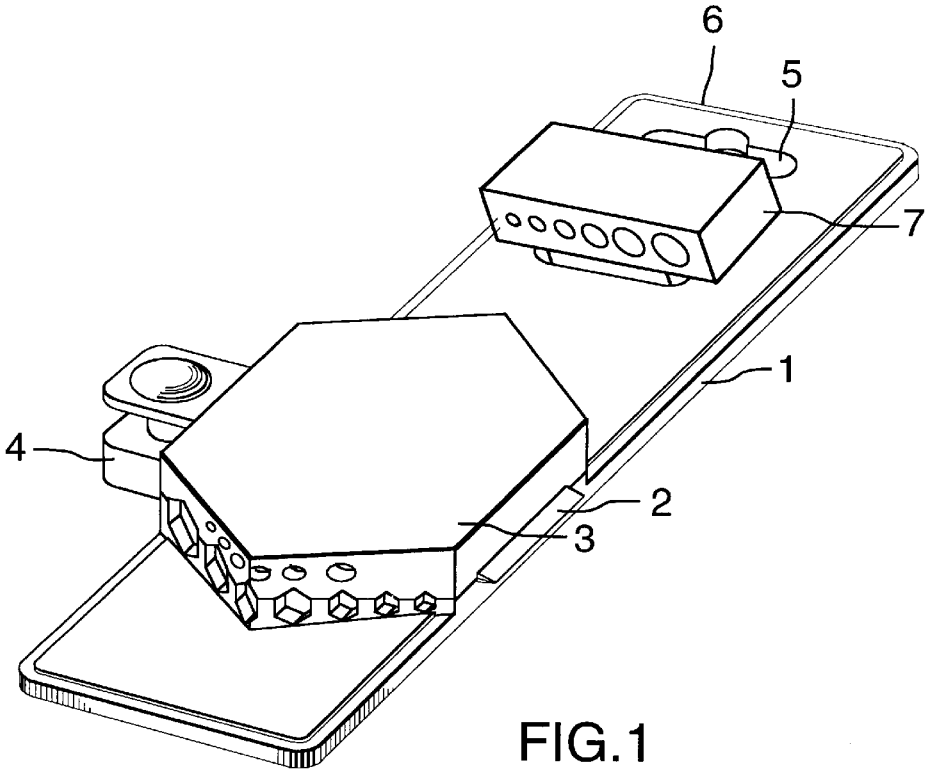
FIG. 1 is a perspective view of the preferred embodiment of the invention.

FIG. 1 shows the preferred embodiment of the invention, where a flat and generally rectangular plastic body 1 is hinged, via a living hinge 2, to a preferably hexagonally-shaped plastic lid 3. It should be understood by those skilled in the art that the lid may be attached to the body by a wide variety of alternative means and such variations are within the scope of this invention. The lid is secured to the body in the closed position by a conventional plastic clasp 4. A hole 5 is defined within the body near its top edge 6, by which the invention can be suspended from a conventional hook at the point of sale.

Figure 2:
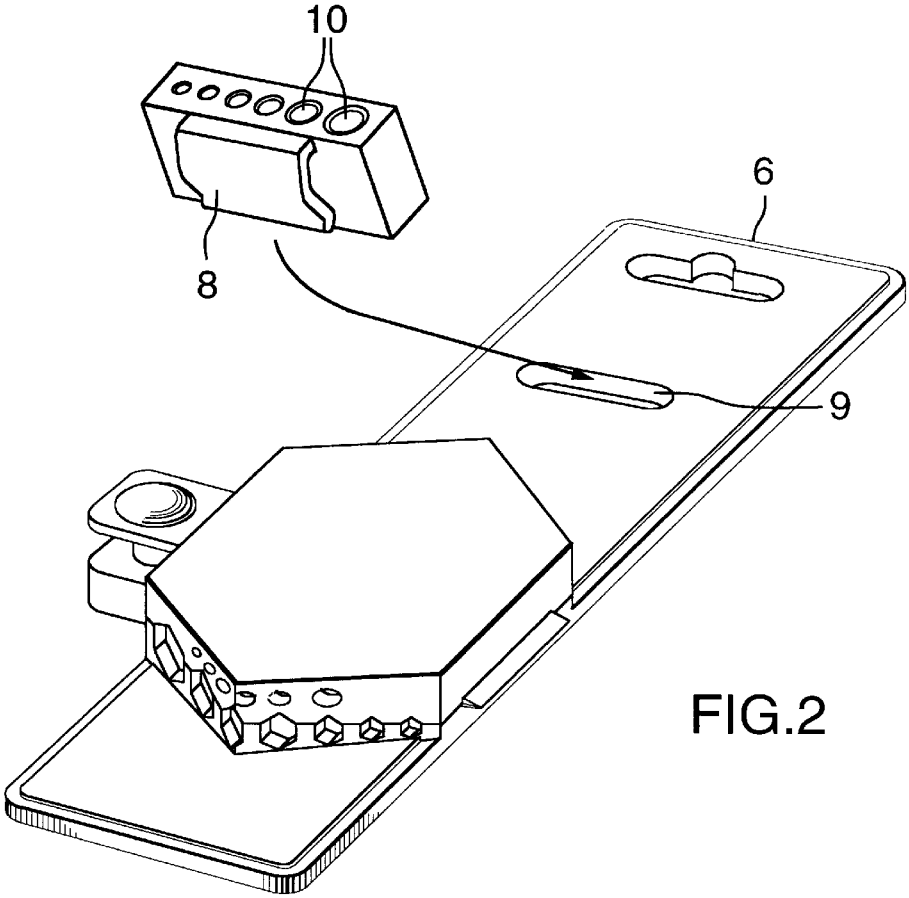
FIG. 2 is an exploded perspective view of the preferred embodiment of the invention.
Figure 16C:
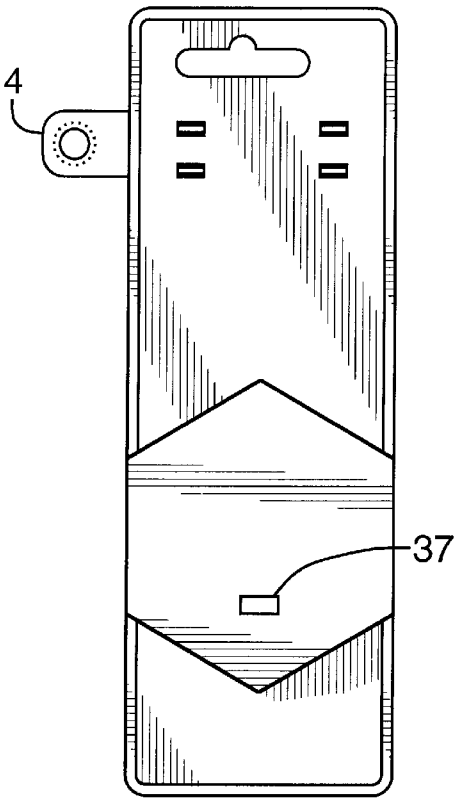
FIGS. 16*a*–16*c* are front, side and rear views respectively showing an alternative means of securing the block.
Figure 16B:
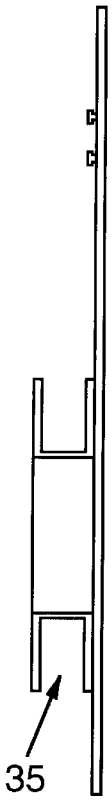
Figure 16A:
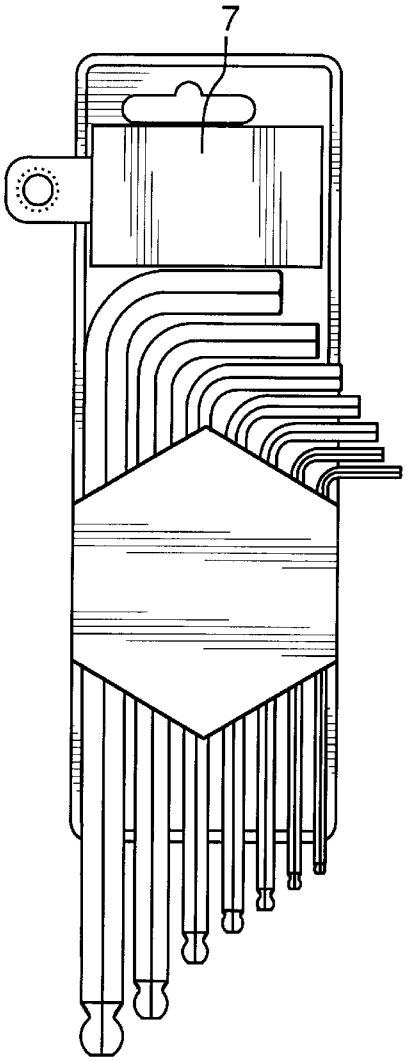

As best shown in FIG. 2, a plastic block 7 is secured to the body preferably by a molded plastic clip 8 which penetrates a corresponding first slit 9 defined within the body 1. The distal end of the clip faces the top edge of the body and the joint between the block and the clip abuts against the edge of the first slit, such that the block is prevented from moving toward the top edge of the body. However, the block may be secured to the body in a number of different ways, such as T-slots, posts, or rails, FIGS. 16*a*–16*c* illustrating one such additional example. A number of circular channels 10 configured to retain most popular hex key sizes penetrate the block.

Figure 3:
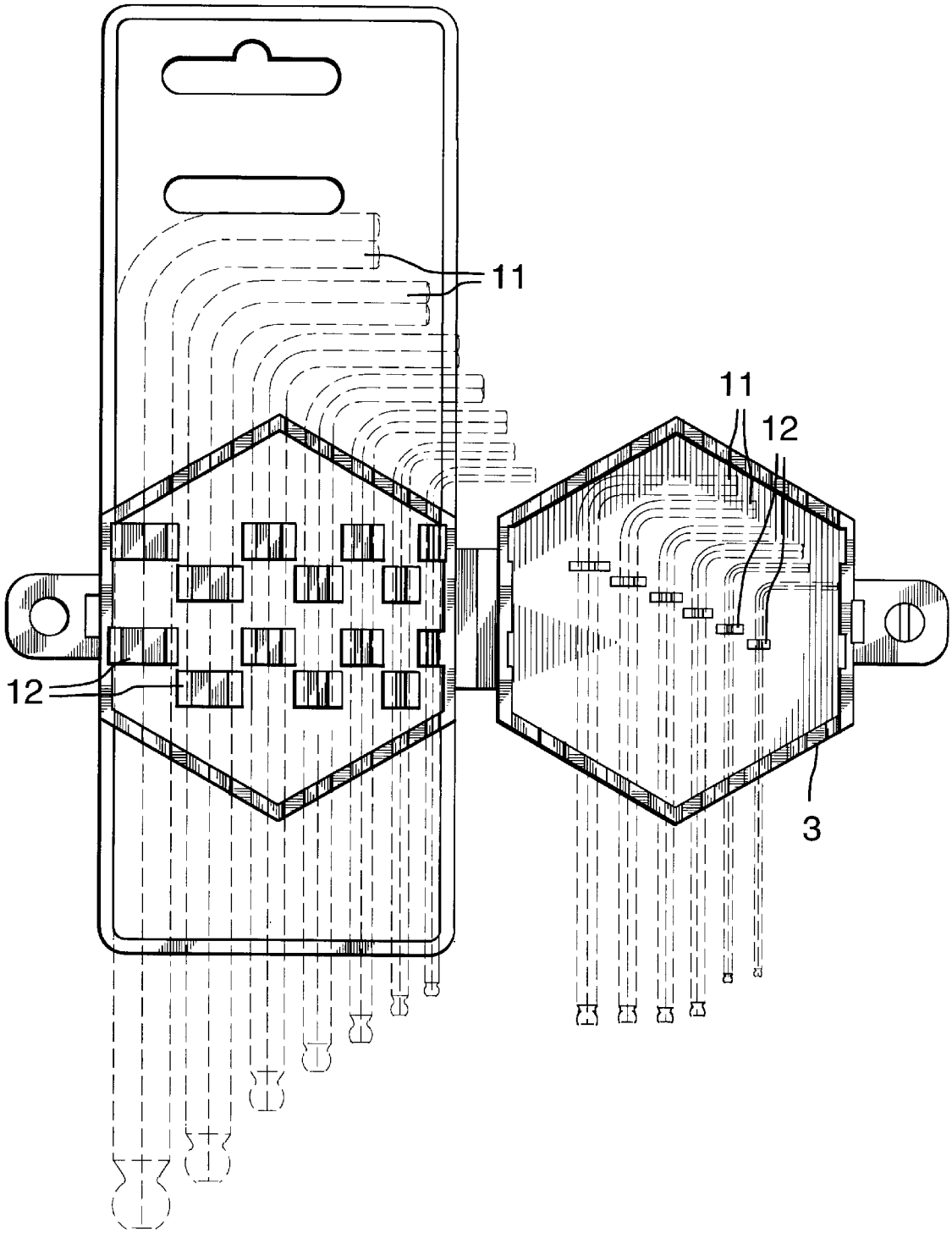
FIG. 3 is a top view of the preferred embodiment showing the lid in the open position.
Figure 4:
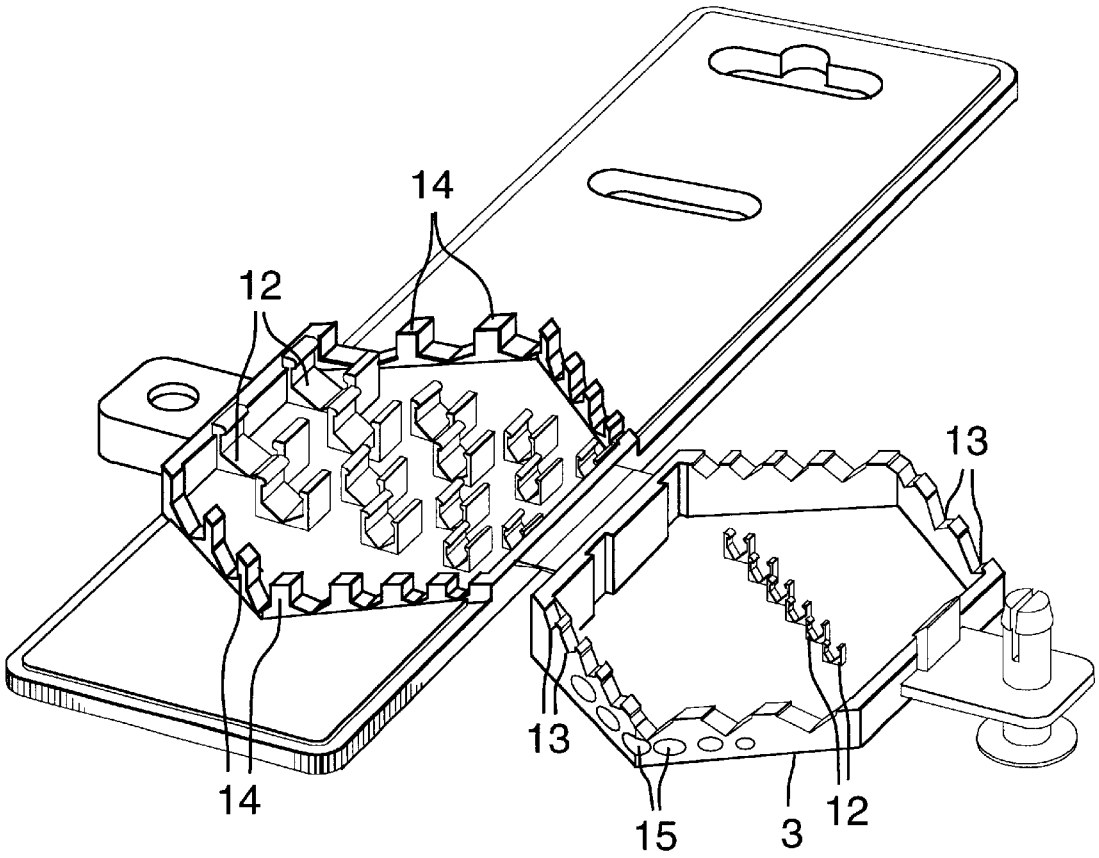
FIG. 4 is a perspective view of the preferred embodiment of the invention showing the lid in the open position.

FIG. 3 shows preferably seven hex keys 11 which are snapped into plastic retaining members 12 molded to the body 1 such that the long end of each hex key is parallel to the side edge 20 of the body while the short end of each hex key is parallel to the top edge 6 of the body. It should be understood by those skilled in the art that a case to retain any number of hex keys may be constructed, and such a variation would be within the scope of this invention. Two retaining members are used to secure each hex key to the body, and each such pair of retaining members is positioned on an axis generally parallel to the side edge of the body within the area covered by the lid 3. FIG. 4 shows preferably semi-hexagonal notches 13 of varying sizes defined within the sides of the lid, and semi-hexagonal projections 14 of varying sizes molded to the body. The notches and projections co-operate to form holes aligned with each pair of retaining members 12 on an axis parallel to the length of the body to receive and secure the hex keys, such that the lid can be closed when the hex keys are stored within the retaining members.

In addition, preferably six circular slots 15 are defined within the sides of the lid facing the bottom edge of the body to receive six hex keys of smaller sizes. The smaller sizes of hex keys are each secured within the lid by a single retaining member 12 such that the short end of each hex key is within the lid and only a section of the long end is exposed for the consumer to examine.

Figure 5:
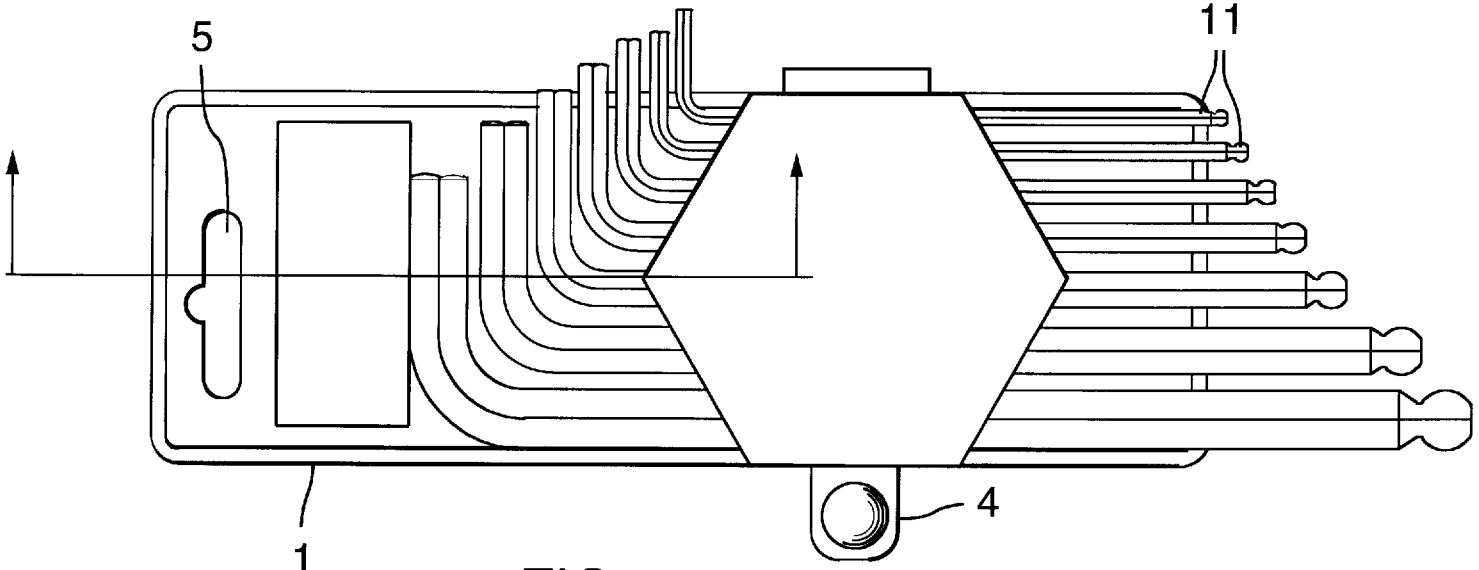
FIG. 5 is a top view of the preferred embodiment of the invention showing the hex keys.
Figure 6:
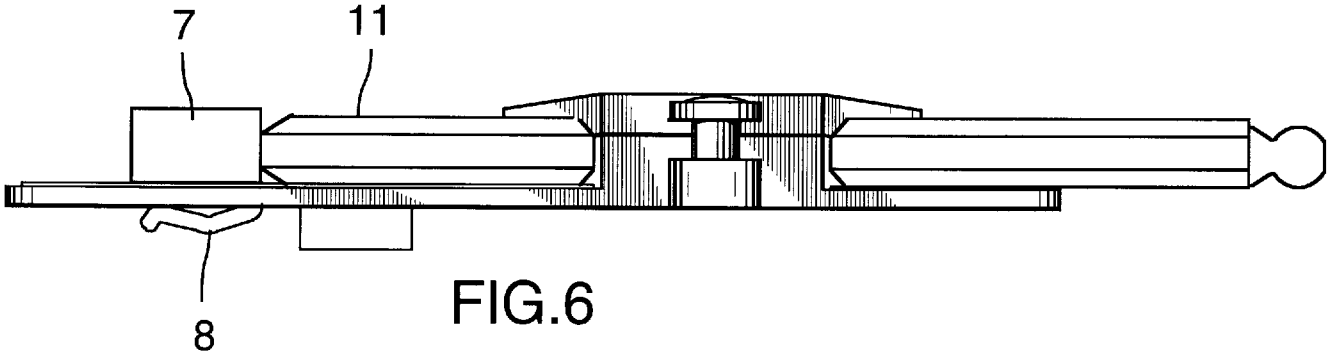
FIG. 6 is an elevation view of the preferred embodiment of the invention showing hex keys stored within the holder.

At the point of sale, the holder is suspended from a hook (not shown) via the hole 5 defined in the body 1, as best shown in FIG. 5. For the sake of clarity, only the larger sizes of hex keys are shown with the holder, but it should be understood that, at the point of sale, the case includes hex keys of smaller sizes described above. The larger hex keys 11 are snapped into the retaining members and covered by the lid 3 which is in the closed position. The ends of the hex keys are exposed to allow the consumer to closely inspect and touch the tools. To prevent unauthorized removal of hex keys by opening the lid, a metal or plastic tie (not shown) threaded through an opening in the clasp 4. Alternatively, if someone attempts to remove a hex key by rotating and/or pulling down on it, the short end of the hex key will abut against the sides of the lid, thereby preventing further movement. As shown in FIG. 6, if an unauthorized attempt to remove the largest size of hex key by rotating and/or pushing up on it is made, the short end of the hex key will abut against the block 7 which, in turn, will cause the joint between the block and the clip 8 to abut against the first slit 9, thereby preventing further movement. If a similar attempt is made to remove any other larger size hex key, the key will abut against an adjacent larger hex key, which in turn will abut against the larger hex key adjacent to it, and so on. Eventually this will cause the largest hex key to abut against the block, thereby preventing removal of the hex keys, as described above. Alternatively, if an unauthorized attempt to remove the block is made, the block abuts the adjacent largest size hex key, thereby preventing its removal. If one of the alternative arrangements described above is used to secure the block to the body, a clasp identical to the clasp 4 is attached to the block and the body, as shown in FIGS. 16*a*–16*c*, to prevent unauthorized removal of the block.

Figure 7:
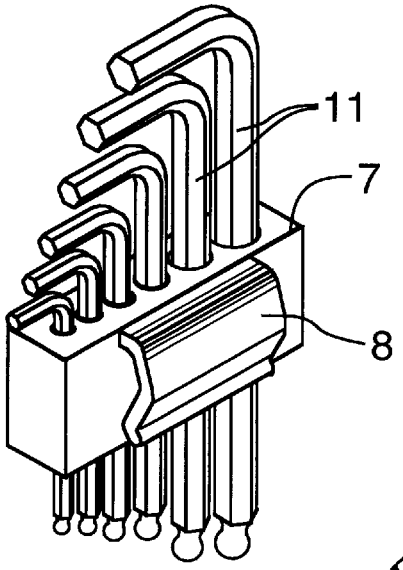
FIG. 7 is a perspective view of the block showing hex keys stored therein.
Figure 8:
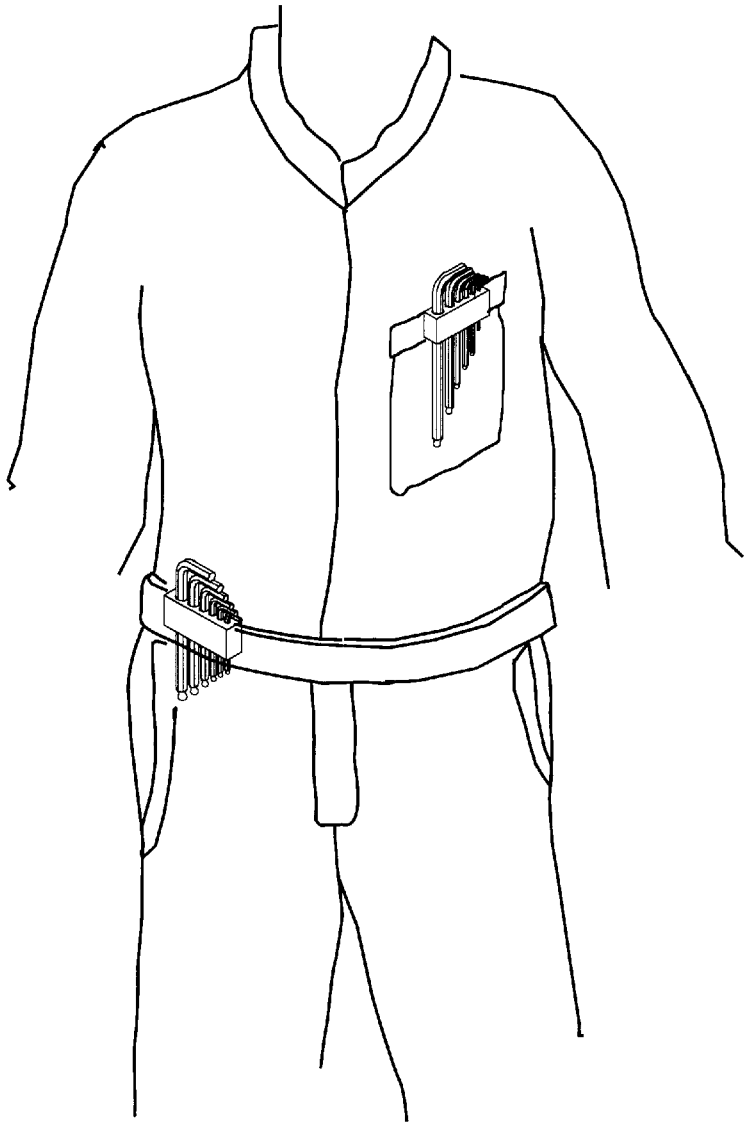
FIG. 8 is a perspective view of the block clipped to the belt and pocket of a user.
Figure 9:
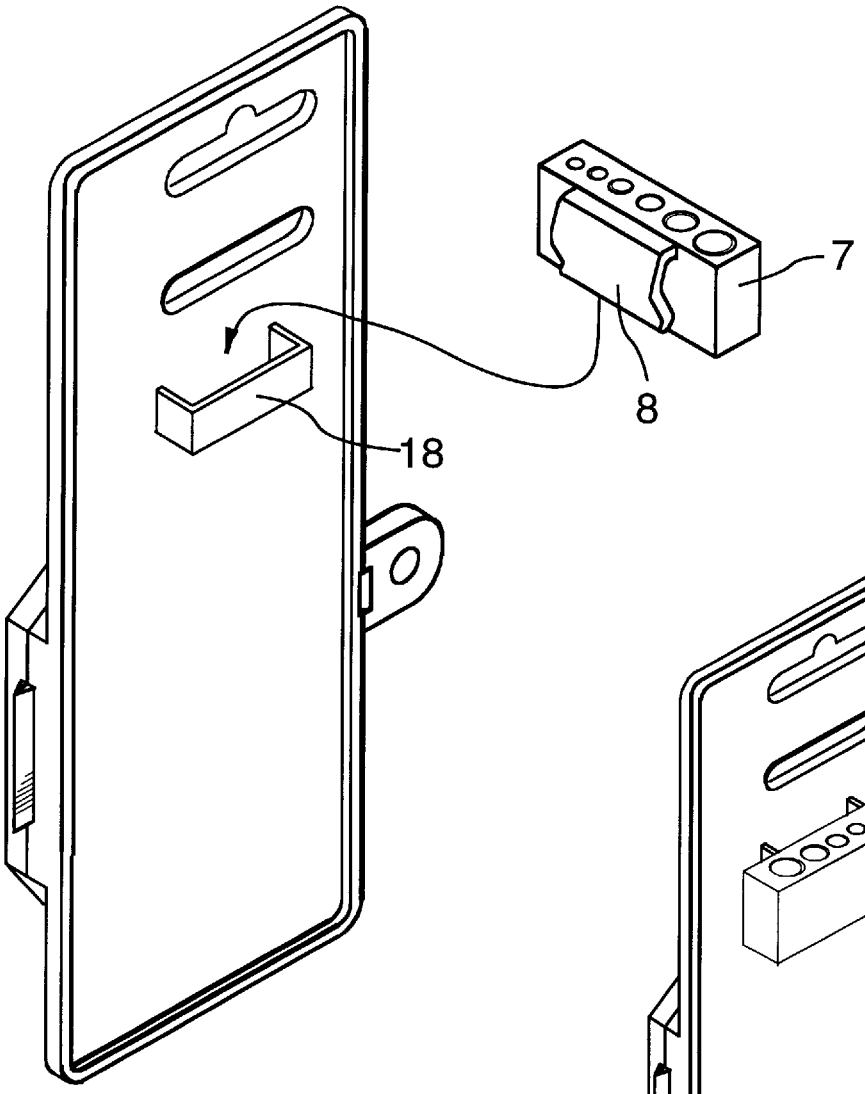
FIG. 9 is an exploded perspective view the bottom surface of the preferred embodiment showing the block stored on the bottom surface of the hex key holder.
Figure 10:
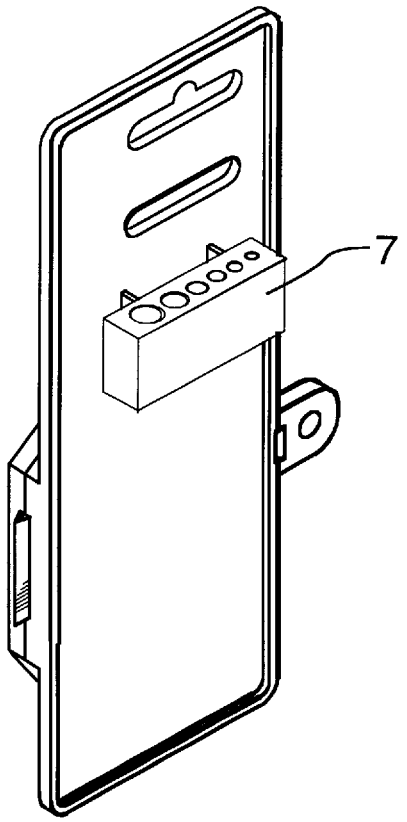
FIG. 10 is a perspective view the bottom surface of the preferred embodiment showing the block stored on the bottom surface of the hex key holder.

After the consumer purchases the hex key holder, he/she can remove the metal tie and open the lid. The consumer can then remove the hex keys and the block. He/she can insert the hex keys in the appropriate circular channels 10 within the block 7 and attach said block with the hex keys to a belt or pocket via the clip 8, as shown in FIGS. 7 and 8. The removal of the block also allows the user to remove hex keys from the case without opening the lid merely by pulling them out of the case. As shown in FIGS. 9 and 10, when the user is not carrying the block on his/her belt, it can be stored by attaching it to a bracket 18 molded to the bottom surface of the body 1.

After purchase, the key holder may be suspended from a conventional hook with the lid 3 in the open position to provide storage for hex keys and to serve as a dispenser.

It will be appreciated that the above description relates to the preferred embodiment by way of example only. Many variations on the invention will be obvious to those knowledgeable in the field, and such obvious variations are within the scope of the invention as described and claimed, whether or not expressly described.

Figure 11:
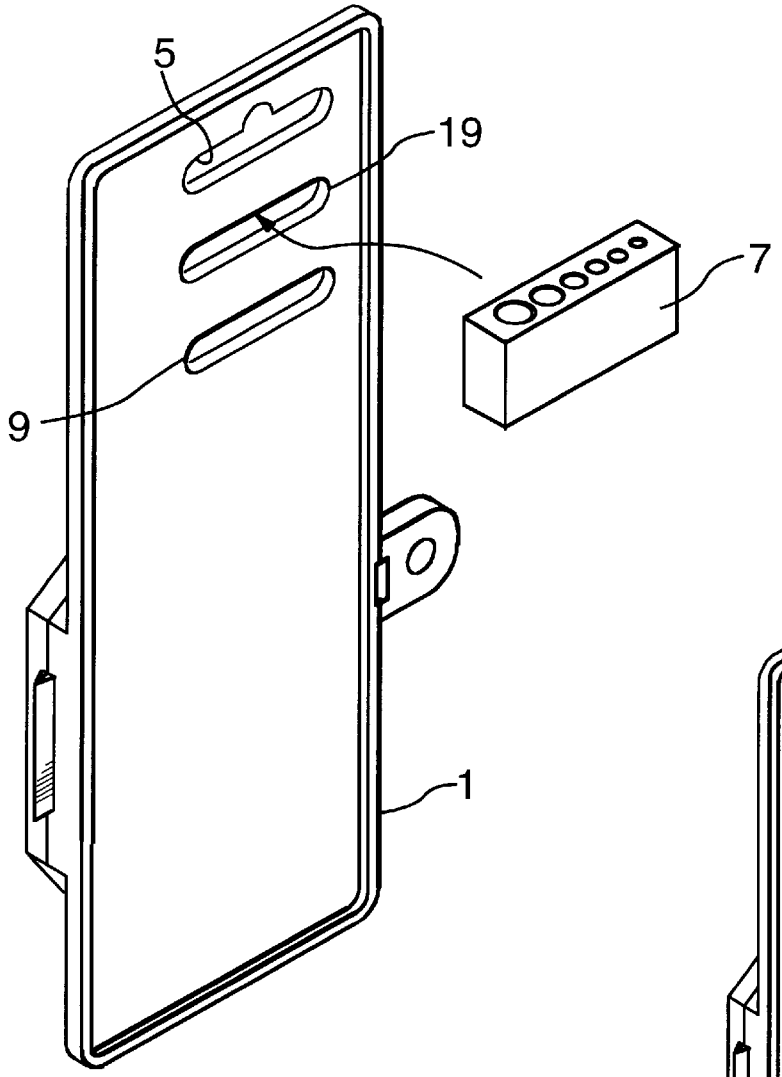
FIG. 11 is an exploded perspective view of an alternative embodiment of the invention.
Figure 12:
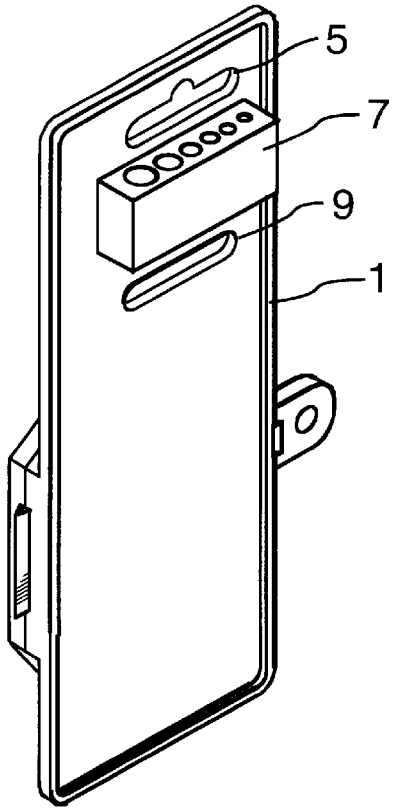
FIG. 12 is a perspective view of the alternative embodiment of the invention.

For example, FIGS. 11 and 12 show an alternative embodiment of the invention where the bracket 18 described in the preferred embodiment is replaced by a second slit 19 defined within the body 1 between the first slit 9 and the hole 5 to store the block 7 against the underside of the body.

Figure 13:
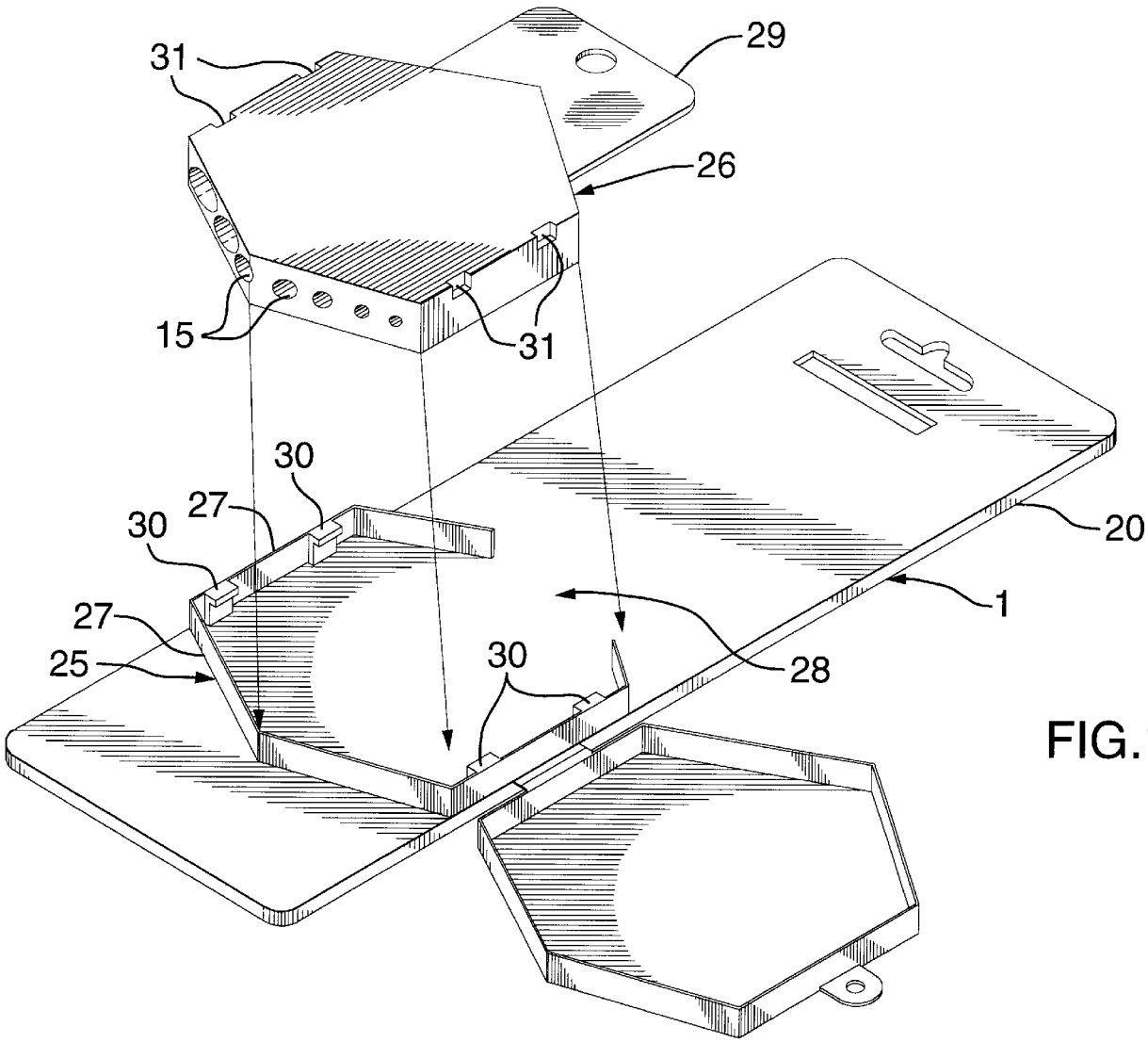
FIG. 13 is an exploded perspective view of an alternative embodiment of the invention showing a snap-in module.
Figure 14:
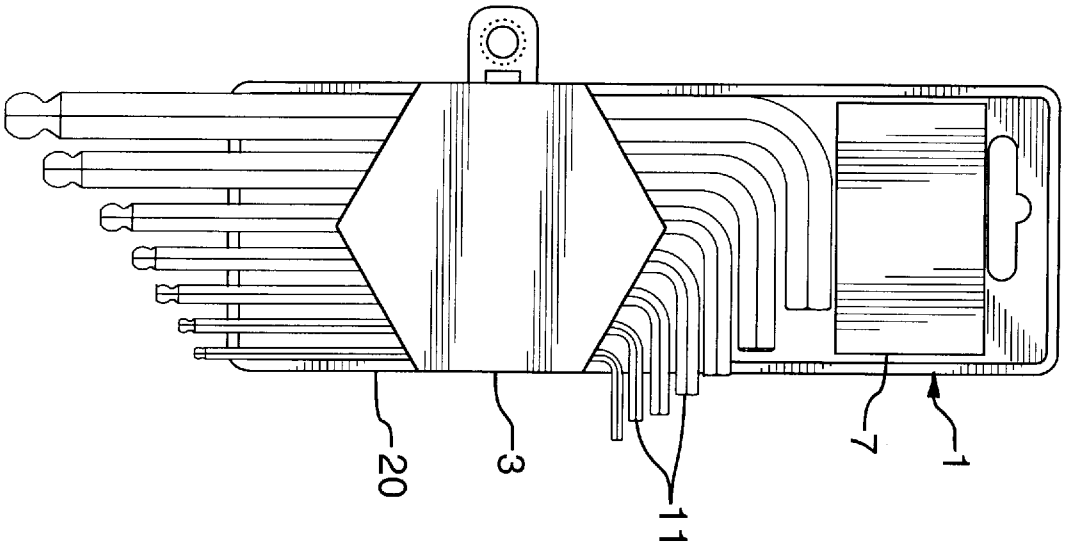
FIG. 14 is a top view of the alternative embodiment of the invention.

FIGS. 13 and 14 show an alternative embodiment of the invention where the body 1 is molded without the plastic retaining members. Instead, five walls 27 are molded to the body to define a generally hexagonal enclosure 25 to accommodate a module 26, which is snapped into the five walls. Although a hexagonally shaped module is shown, the module and the enclosure can be molded in a wide variety of shapes. The module is secured within the receiving frame by any suitable means, such as two sets of two finger tabs 30, each molded to opposing walls of the frame which locate in corresponding female connections 31 defined within the sides of the module 26. A cut-out 28 is defined at the top edge of the enclosure to accommodate a hanging tab 29 molded to the top of the module. Slots 15 are defined within opposing top and bottom sides of the module to receive a number of hex keys 11 such that the hex keys align on an axis parallel to the side edge 20 the body. Although the module, as shown, is molded with circular slots to accommodate seven hex keys of various sizes, modules with hexagonal slots accommodating different numbers of hex keys depending on their size may also be interchangeably secured within the body. The various modules may also be colour-coded for various styles and types of hex keys, such as SAE or Metric.

Figure 15:
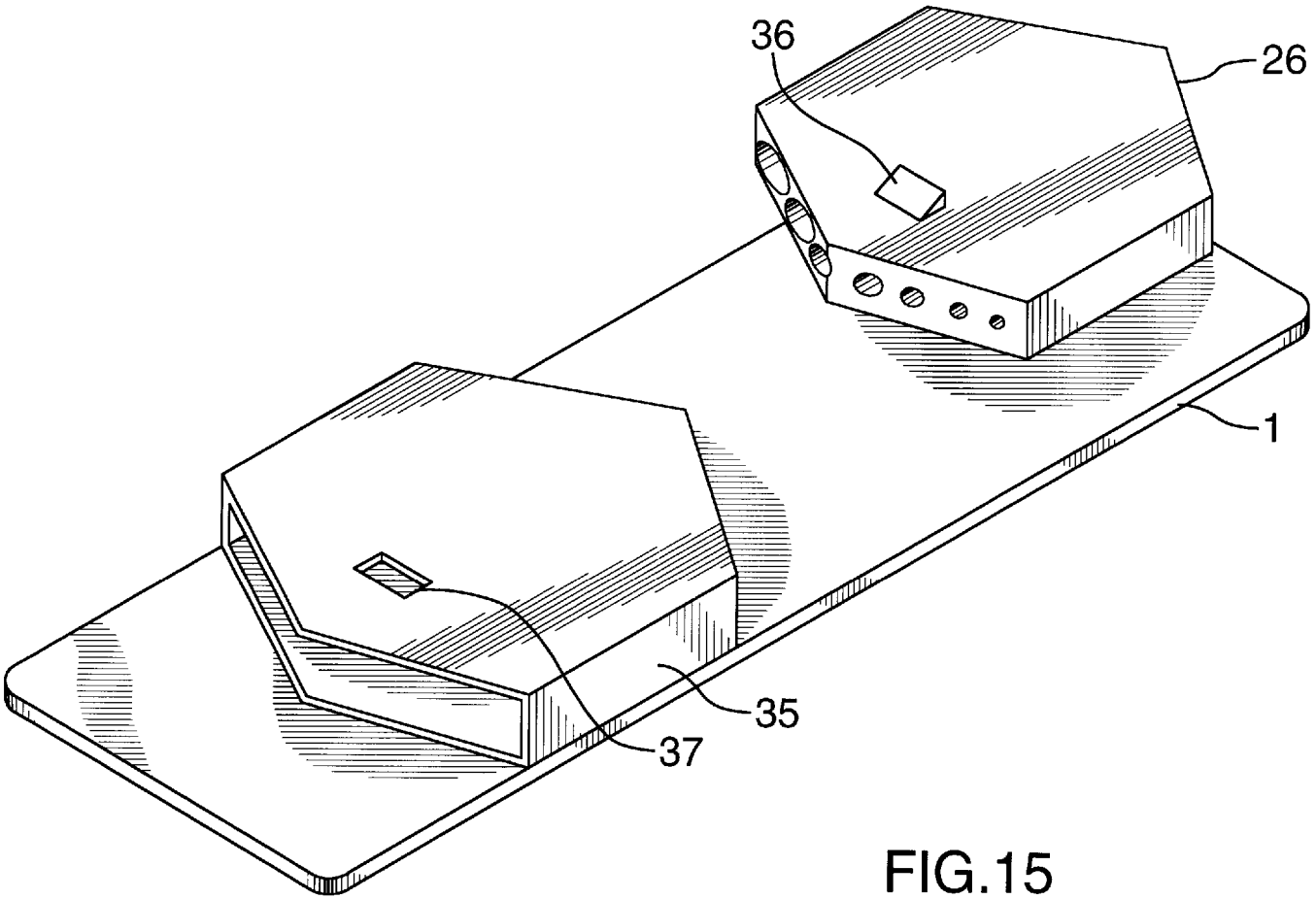
FIG. 15 is an exploded perspective view of an alternative embodiment of the invention showing the covered enclosure.

FIG. 15 shows an alternative embodiment of the invention where a generally hexagonal covered enclosure 35 is molded to the body 1. Openings in the top and bottom of the covered enclosure are defined to slidably receive a module 26. The module is identical to that shown in FIG. 13 other than the hanging tab is removed and the module is secured to the top of the enclosure by a male engagement tab 36 molded to the top surface of the module which is secured within a corresponding female engagement slot 37 defined within the top surface of the covered enclosure.

What is claimed as the invention is:

1. A hex key holder comprising:

a generally flat body having:

a top surface and a bottom surface; and an enclosure portion and a top portion extending above said enclosure portion;

a lid pivotably connected to a side edge of said body, pivotable onto said body and securable thereto so as to define an enclosed area in said enclosure portion, said lid and said body, when said lid is closed, cooperatively defining a plurality of holes into said enclosed area, each having an axis generally parallel to said side edge of said body, each configured to receive a hex key;

a block removably secured to said top portion of said body, positioned so as to block removal of hex keys from said holes when said lid is secured against said body, said block not being removable from said body as long as said lid is secured against said body.

2. A hex key holder as defined in claim 1, wherein said body further comprises a first slit defined within said top portion thereof and said block further comprises a clip molded to the underside thereof, positionable through said first slit such that it may be removed only by sliding said block relative to said body, such sliding being prevented when hex keys are carried by said lid and said lid is closed.

3. A hex key holder as defined in claim 2, wherein said bottom surface of said body has a bracket thereto, said bracket configured to receive said clip for storage of said block.

4. A hex key holder as defined in claim 1, wherein said block further comprises at least one channel defined within said block configured to receive a hex key.

5. A hex key holder as defined in claim 2, wherein said block further comprises at least one channel defined within said block configured to receive a hex key.

6. A hex key holder as defined in claim 1, wherein said body further comprises a hole defined in said top portion of said body securable to a conventional hook at the point of sale.

7. A hex key holder as defined in claim 1, wherein said enclosure portion of said body further comprises a plurality of retaining members molded thereto, said retaining members positioned to secure each hex key received by said plurality of holes.

* * * * *